US005269131A

United States Patent [19]

Brophy

[11] Patent Number: 5,269,131

[45] Date of Patent: Dec. 14, 1993

[54] SEGMENTED ION THRUSTER

[75] Inventor: John R. Brophy, Valencia, Calif.

[73] Assignee: The United States of America as represented by the Administrator of the National Aeronautics and Space Administration, Washington, D.C.

[21] Appl. No.: 934,988

[22] Filed: Aug. 25, 1992

[51] Int. Cl.[5] ..... H05H 1/00

[52] U.S. Cl. ..... 60/202

[58] Field of Search ..... 60/202; 313/359.1, 360.1; 315/111.01, 111.21

[56] References Cited

U.S. PATENT DOCUMENTS

| | | | |
|---|---|---|---|
| 3,412,559 | 11/1968 | Sohl | 60/202 |
| 3,447,015 | 5/1969 | Reader et al. | 60/202 |
| 3,500,122 | 3/1970 | Sohl | 60/202 |
| 3,604,209 | 9/1971 | King et al. | 60/202 |
| 3,744,247 | 7/1973 | Margosian et al. | 60/202 |
| 3,795,833 | 3/1974 | King et al. | 60/202 |
| 3,956,666 | 5/1976 | Reader et al. | 60/202 |
| 4,277,939 | 7/1981 | Hyman, Jr. | 60/202 |
| 4,866,929 | 9/1989 | Knowles et al. | 60/202 |
| 5,146,742 | 9/1992 | Iida et al. | 60/202 |

OTHER PUBLICATIONS

S. Nakanishi & E. V. Pawlik, "Experimental Investigation of a 1.5-m-diam Kaufman Thruster", J. Spacecraft, vol. 5, No. 7, Jul. 1968, pp. 801-807.

D. C. Byers, "An Experimental Investigation of a High--Voltage Electron-Bombardment Ion Thruster", NASA Technical Memorandum TMX-52429, May 5-9, 1968, pp. 1-42.

V. K. Rawlin, "Operation of the J-Series Thruster Using Inert Gas", NASA Technical Memorandum 82977, AIAA-82-1929, Nov. 17-19, 1982, 17 p.

D. L. Galecki and M. J. Patterson, "Nuclear Powered Mars Cargo Transport Mission Utilizing Advanced Ion Propulsion", NASA Technical Memorandum 100109, AIAA-87-1903, Jun. 29-Jul. 2, 1987, 29 p.

V. K. Rawlin, "Internal Erosion Rates of a 10kW Xeon Ion Thruster", NASA Technical Memorandum 100954, AIAA-88-2912, Jul. 11-13, 1988, 30 p.

M. J. Patterson and V. K. Rawlin, "Performance of 10kW Class Xeon Ion Thrusters", NASA Technical Memorandum 191292, AIAA-88-2914, Jul. 11-13, 1988, 30 p.

V. K. Rawlin, and M. G. Millis, "Ion Optics for High Power 50-cm-diam Ion Thrusters", NASA Technical Memorandum 102143, AIAA-89-2717, Jul. 10-12, 1989, 23 p.

Y. Yamagiwa, et al., "A 30-CM Diameter Xenon Ion Thruster-Design and Initial Test Results", N89-27768, 88-095, pp. 530-534, Date Unknown.

M. J. Patterson and T. R. Verhey, "5-kW Xenon Ion Thruster Lifetest", NASA Technical Memorandum 103191, AIAA-90-2543, Jul. 18-20, 1990, 53 p.

J. H. Gilland, R. M. Myers and M. J. Patterson, "Multimegawatt Electric Propulsion System Design Considerations", NASA Technical Memorandum 105152, AIAA-90-2552, Jul. 16-20, 1990, 16 p.

J. H. Gilland, "Synergistic Use of High and Low Thrust Propulsion Systems for Piloted Missions to Mars", NASA Contractor Report 189138, AIAA-91-2346, Mar. 1992, 13 p.

R. H. Frisbee, J. J. Blandino and S. D. Leifer, "A Comparision of Chemical Propulsion, Nuclear Thermal Propulsion, and Multimegawatt Electric Propulsion for Mars Missions", AIAA 91-2332, Jun. 24-26, 1991, pp. 1-23.

(List continued on next page.)

*Primary Examiner*—Richard A. Bertsch
*Assistant Examiner*—Howard R. Richman
*Attorney, Agent, or Firm*—John H. Kusmiss; Thomas H. Jones; Guy M. Miller

[57] ABSTRACT

Apparatus and methods for large-area, high-power ion engines comprise dividing a single engine into a combination of smaller discharge chambers (or segments) configured to operate as a single large-area engine. This segmented ion thruster (SIT) approach enables the development of 100-kW class argon ion engines for operation at a specific impulse of 10,000 s. A combination of six 30-cm diameter ion chambers operating as a single engine can process over 100 kW. Such a segmented ion engine can be operated from a single power processor unit.

14 Claims, 6 Drawing Sheets

OTHER PUBLICATIONS

H. F. Bassner, H.-P. Berg, and R. Kukies, "Status of the Space Testing Programs of the RF-Ion Thruster RIT 10", AIAA 91-1889, Jun. 24-27, 1991, pp. 1-9.

K. J. Hack, J. A. George, and J. P. Riehl, "Evolutionary Use of Nuclear Electric Propulsion", AIAA 90-3821, Sep. 25-28, 1990, pp. 1-20.

J. R. Brophy and J. W. Barnett, "Benefits of Electric Propulsion for the Space Exploration Initiative", AIAA 90-2756, Jul. 16-18, 1990, pp. 1-11.

R. H. Frisbee, et al., "Advanced Propulsion Options for the Mars Cargo Mission", AIAA 90-1997, Jul. 16-18, 1990, pp. 1-21.

D. G. Fearn, "The Control Philosophy of the UK-10 and UK-25 Ion Thrusters", AIAA 90-2629, Jul. 18-20, 1990, pp. 1-10.

P. M. Latham, A. R. Martin and A. Bond, "Design, Manufacture and Performance of the UK-25 Engineering Model Thruster", AIAA 90-2541, Jul. 18-20, 1990, pp. 1-7.

K. H. Groh, et al., "Inert Gas Performance of the RIT 35 Main Propulsion Unit", A89-47491, 88-098, Oct. 3-6, 1988, pp. 545-551.

Y. Nakamura, et al., "Discharge Performance of a 12 CM CUSP Xeon Ion Thruster", A89-47466, 88-061, Oct. 3-6, 1988, pp. 349-357.

G. Aston and J. R. Brophy, "A 50 cm Diameter Annular Ion Engine", A89-47039, AIAA 89-2716, Jul. 10-12, 1989, pp. 1-7.

G. Aston and J. R. Brophy, "A Detailed Model of Ion Propulsion Systems", A89-46712, AIAA 89-2268, Jul. 10-12, 1989, pp. 1-14.

J. R. Brophy and C. E. Garner, "Tests of High Current Hollow Cathodes for Ion Engines", A88-53115, AIAA 88-2913, Jul. 11-13, 1988, pp. 1-10.

R. T. Bechtel, "The 30 cm J Series Mercury Bombardment Thruster", A81-29550, AIAA 81-0714, Apr. 21-23, 1981, pp. 1-14.

FIG. 1. (PRIOR ART)
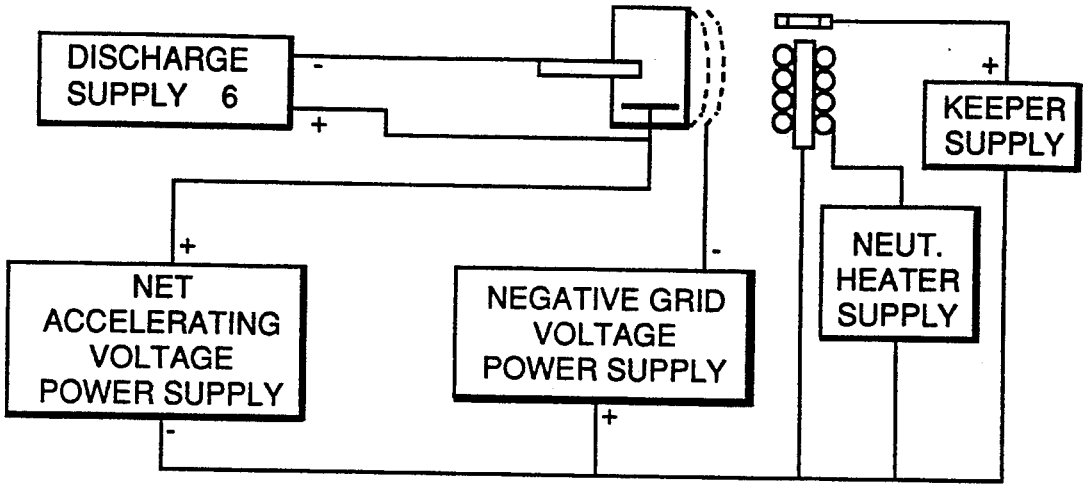
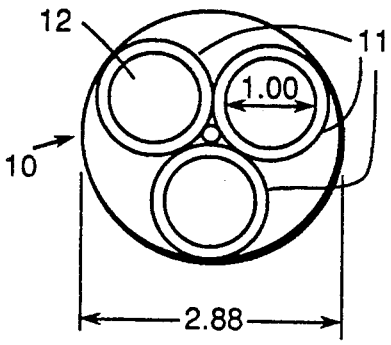
FIG. 4a.
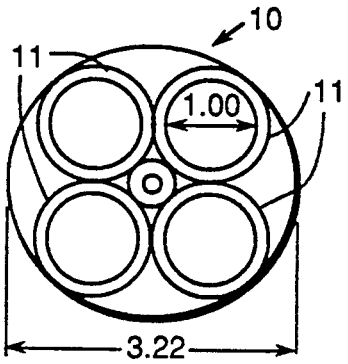
FIG. 4b.
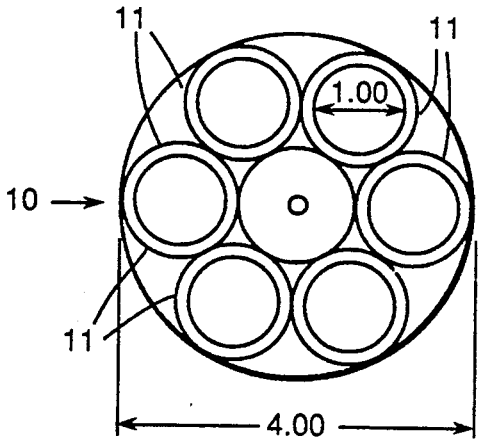
FIG. 4c.
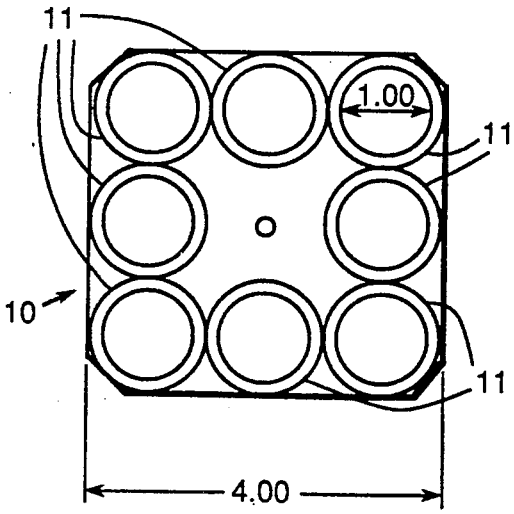
FIG. 4d.

SEGMENTED ION THRUSTER

ORIGIN OF THE INVENTION

The invention described herein was made in the performance of work under a NASA Contract, and is subject to the provisions of Public Law 96-517 (35 U.S.C. 202) in which the Contractor has elected not to retain title.

TECHNICAL FIELD

The invention relates to methods and apparatus for electrostatic propulsion, and in particular to an approach to high-power ion engine design that makes possible the development of noble gas ion engines capable of processing hundreds of kilowatts of input power at specific impulses in the range 7,000 to 10,000 seconds, and enables the scaling of ion engines up to the megawatt power levels.

BACKGROUND ART

High-power ion propulsion systems have been shown to be capable of providing substantial benefits for the exploration of space. Considerable useful background material is contained in the following papers: (1) Brophy, J. R. and Barnett, J. W., "Benefits of Electric Propulsion for the Space Exploration Initiative," AIAA Paper No. 90-2756, July 1990; (2) Gilland, J. H., Myers, R. M., and Patterson, M. J., "Multimegawatt Electric Propulsion System Design Considerations," AIAA Paper No. 90-2552, July 1990; (3) Frisbee, R. H., et al., "Advanced Propulsion Options for the Mars Cargo Mission." AIAA Paper No. 90-1997, July 1990; (4) Hack, K. J., et al., "Evolutionary Use of Nuclear Electric Propulsion," AIAA Paper No. 90-3821, September 1990; (5) Galecki, D. L., and Patterson, M. J., "Nuclear Powered Mars Cargo Transport Mission Utilizing Advanced Ion Propulsion," NASA TM 100109, July 1987; (6) Gilland, J. H., "Synergistic Use of High and Low Thrust Propulsion Systems for Piloted Missions to Mars," AIAA-91-2346, June 1991; and (7) Frisbee, R. H., Blandino, J. J., and Leifer, S. D., "A Comparison of Chemical Propulsion, Nuclear Thermal Propulsion, and Multimegawatt Electric Propulsion for Mars Missions," AIAA-91-2332, June 1991.

However, for ion propulsion to fulfill its promise requires the development of ion engines which can process input powers on the order of hundreds to thousands of kilowatts at specific impulses in the range 7,000 to 10,000 seconds with useful lifetimes of 10,000 hours. From 1961 to approximately 1981 most ion engine research focused on the use of mercury as the propellant. A 150-cm diameter mercury ion engine was operated at input powers as high as 130 kW with a specific impulse of 8,150 seconds and an overall efficiency of 70%, as reported in the paper by Nakanishi, S. and Pawlik, E. V., "Experimental Investigation of a 1.5 m-diam. Kaufman Thruster," J. Spacecraft, Vol. 5, No. 7, July 1968, pp. 801–807.

In other work a mercury ion engine was operated at specific impulses greater than 16,000 seconds, as reported in the paper by Byers, D. C., "An Experimental Investigation of a High-Voltage Electron-Bombardment Ion Thruster," NASA TM X-52429, May 1968. The J-Series mercury ion thruster, which was designed for a maximum input power of 2.7 kW at a specific impulse of 3,000 seconds, was developed to nearly flight readiness for use in the Solar Electric Propulsion Stage (SEPS), as reported in the paper by Bechtel, R. T., "The 30 cm J Series Mercury Bombardment Thruster," AIAA Paper No. 81-0714, April 1981.

Since 1981 most ion propulsion research has centered on the use of noble gas propellants, with engine sizes ranging from 10 cm to 50 cm. The following papers and their references report much of that research: Fearn, D. G., "The Control Philosophy of the UK-10 and UK-25 Ion Thruster," AIAA Paper No. 90-2629, July 1990; Latham, P. M., Martin A. R., and Bond, A., "Design Manufacture and Performance of the UK-25 Engineering Model Thruster," AIAA Paper No. 90-2541, July 1990; Bassner, H., "Status of the Space Testing Programs of the RF-Ion Thruster RIT-10," AIAA Paper No. 91-1889, June 1991; Groh, K. H., et al., "Inert Gas Performance of the RIT 35 Main Propulsion Unit," IEPC-88-098, presented at the 20th International Electric Propulsion Conference, Garmisch-Partenkirchen, Germany, October 1988; Beattie, J. R. and Matossian, J. N., "Xenon Ion Propulsion for Stationkeeping and Orbit Rasing, "IEPC-88-052, presented at the 20th International Electric Propulsion Conference, Oct. 1988; Patterson, M. J. and Verhey, T. R., "5 kW Xenon Ion Thruster Life Test," AIAA Paper No. 90-2543, July 1990; Patterson, M. J. and Rawlin, V. K., "Performance of 10-kW Class Xenon Ion Thrusters," AIAA 88-2914, July 1988; Nakamura, Y., Matsumoto, M., Kitamura, S., and Miyazaki, K., "Discharge Performance of a 12 cm Cusp Xenon Ion Thruster," IEPC 88-061, presented at the 20th International Electric Propulsion Conference in Garmisch-Parternkirchen, Germany, October 1988; and Yamagiwa, Y., et al., "A 30-cm Diameter Xenon Ion Thruster—Design and Initial Test Results," IEPC 88-095, presented at the 20th International Electric Propulsion Conference in Garmisch-Partenkirchen, Germany, October 1988.

The 30-cm diameter J-Series thruster has been operated at input powers up to 17 kW with a specific impulse of 4,400 seconds using xenon propellant, as reported by Patterson, M. J. and Rawlin, V. K., "Performance of 10-kW Class Xenon Ion Thrusters," AIAA 88-2914, July 1988. The same paper also reports a 50-cm diameter thruster has been operated at up to 20 kW at a specific impulse of 4,600 seconds, again with xenon.

Ion engines operate by ionizing the propellant gas through electron bombardment and then accelerating the resulting positive ions electrostatically. The magnitude of the applied high voltage which accelerates the ions and the ion charge-to-mass ratio determines the exhaust velocity. Typically greater than 85% of the input power is processed by the positive high-voltage supply which accelerates the ions. Most of the remaining 15% of the input power goes into creating the ions and is supplied by a separate discharge power supply as indicated in the generic power supply schematic shown in FIG. 1.

The attractive feature of ion propulsion is that the electrostatic acceleration process is almost 100% efficient. In practice the acceleration efficiency is typically 99.7% This nearly lossless acceleration mechanism enables the development of ion engines which can process megawatts of input power while maintaining reasonable engine component temperatures without active cooling. It also is responsible for the high overall engine efficiencies characteristic of ion propulsion. Furthermore, this feature guarantees that scaling ion engines up to megawatt power levels is rewarded with an engine efficiency close to that of prior-art efforts.

Space charge effects in the accelerator system of ion engines place an upper limit on the thrust density (and hence power density) which ion engines can achieve at a given specific impulse. Therefore, to increase the power and thrust capabilities of an ion engine it is necessary to increase the area of the ion accelerator system while maintaining a constant thrust density.

For conventional ion engines with a circular cross section, increasing the accelerator system area is accomplished by increasing the engine diameter. This has led to the development of engines sizes ranging from 5 to 150 cm in diameter over the past 30 years.

To maintain a constant thrust (and power) density as the engine diameter is increased requires that the grid-to-grid separation remain constant. This requirement results in increasing values of the grid span-to-gap ratio, i.e., the ratio of accelerator system diameter to the grid separation. The current state-of-the-art 30-cm diameter ion accelerator system has a span-to-gap ratio of approximately 500. The maximum achievable span-to-gap ratio is limited by mechanical constraints imposed by fabrication and handling procedures, as well as by thermal effects which serve to alter the grid separation during engine operation.

A conventional circular ion engine using argon propellant and operating at a specific impulse of 10,000 seconds would require a beam diameter of approximately 2.2 m to process one megawatt. Assuming a maximum electric field between the grids of 3000 V/mm, this thruster would require the development of an accelerator system with a span-to-gap ratio of about 1700. This is a factor of 3.4 beyond the state of the art, and would have to be developed for an engine diameter which is more than a factor of seven greater than the present 30-cm thruster.

Aside from increasing the active grid area, the power processed by an ion engine may be increased by increasing the net accelerating voltage. For a given propellant this voltage determines the engine specific impulse. For the Mars cargo and piloted Mars missions using electric propulsion, specific impulses in the range 7,000 to 10,000 seconds are required. With argon propellant, this translates into net accelerating voltages which are roughly a factor of two higher than that typically used on the 30-cm thruster with xenon propellant (which was designed for operation at specific impulses less than 4,000 seconds).

Finally, the use of lighter atomic mass propellants increases the current handling capability of the accelerator system at a given voltage, which in turn increases the power processed by the engine. Therefore, to scale ion engines up to megawatt power levels it is necessary to significantly increase the active accelerator system area, operate at high applied net accelerating voltages, and use light atomic mass propellants. The last two of these items must together be consistent with the specific impulse range required for the application of the high-power engine.

The development of 100-kW and megawatt class ion engines must be achieved primarily by scaling up the active grid area for beam extraction by one or two orders of magnitude from the current state of the art. To overcome span-to-gap limitations associated with continuously increasing the diameter of the conventional circular ion engine, alternate engine geometries have been proposed, including an annular engine configuration (such as described in the paper by Aston, G. and Brophy, J. R., "A 50-cm Diameter Annular Ion Engine," AIAA-89-2716, July 1989) and a rectangular engine design (such as described in the paper by Gilland, J. H., Myers, R. M. and Patterson, M. J., "Multimegawatt Electric Propulsion System Design Considerations," AIAA-90-2552, July 1990).

STATEMENT OF THE INVENTION

Apparatus and methods for large-area, high-power ion engines are presented. Conceptually, a single engine is divided into a combination of smaller discharge chambers (or segments) configured to operate as a single large-area engine. This segmented ion thruster (SIT) approach enables the development of 100-kW class argon ion engines for operation at a specific impulse of 10,000 s. A combination of six 30-cm diameter ion chambers operating as a single engine can process over 100 kW. Such a segmented ion engine can be operated from a single power processor unit. The segmented engine design approach may also enable the development of megawatt-class ion engines. Benefits of the segmented ion thruster design include: mitigation of the span-to-gap problem central to the development of large-area, high-power ion engines; reduction in hollow-cathode emission current requirements; improved fault tolerance; and reduced vacuum system pumping speed requirements for engine development testing.

The novel features which are characteristic of the invention will be better understood from the following description in connection with the accompanying drawings. It should be appreciated, however, that each of the drawings is given for the purpose of illustration and description only and that the drawings are not intended to be a definition of the limits of the present invention.

BRIEF DESCRIPTION OF THE DRAWINGS

FIG. 1 is a schematic diagram Of a prior-art generic ion engine power supply.

FIGS. 4*a*, 4*b*, 4*c*, and 4*d* depict configurations of the segmented ion thruster having three, four, six, and eight segments, respectively.

DETAILED DESCRIPTION OF THE INVENTION

Figure 2:
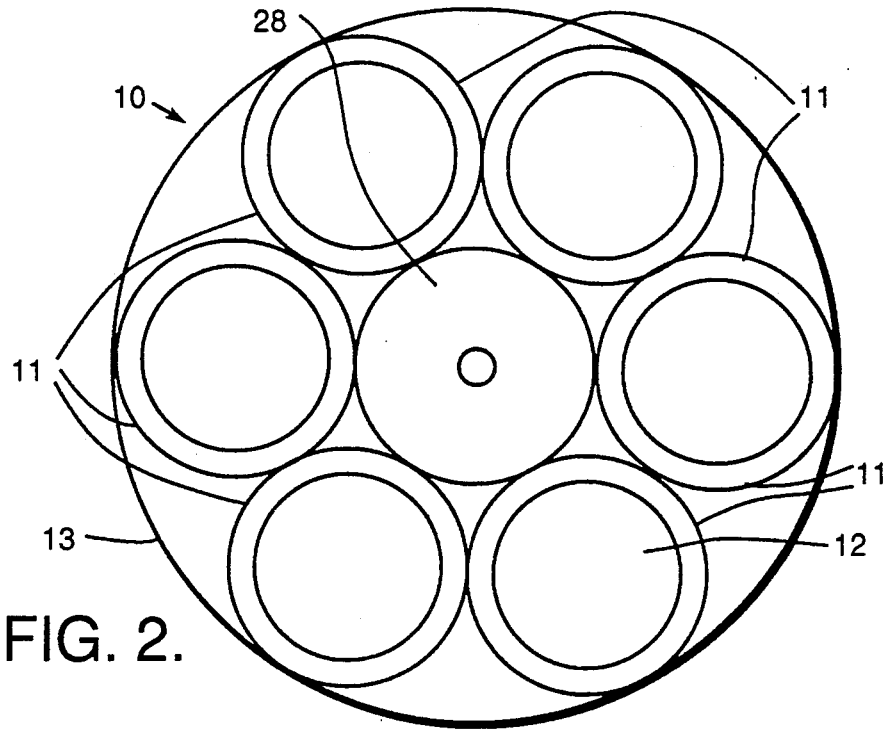
FIG. 2 depicts an example of the segmented ion thruster (SIT) of the present invention with six ion source chambers.

The present invention comprises a "Segmented Ion Thruster" (SIT) in which multiple grid sets together with discrete ion sources (or segments) are used to increase the total active grid area per "engine." In accordance with the invention an example of a segmented ion thruster 10 which uses six discrete ion sources 11 is shown in FIG. 2. The total accelerator system area is six times the area 12 of each individual ion source segment 11. The ion engine outer boundary and ground screen is defined by reference numeral 13 in FIG. 2.

Figure 3:
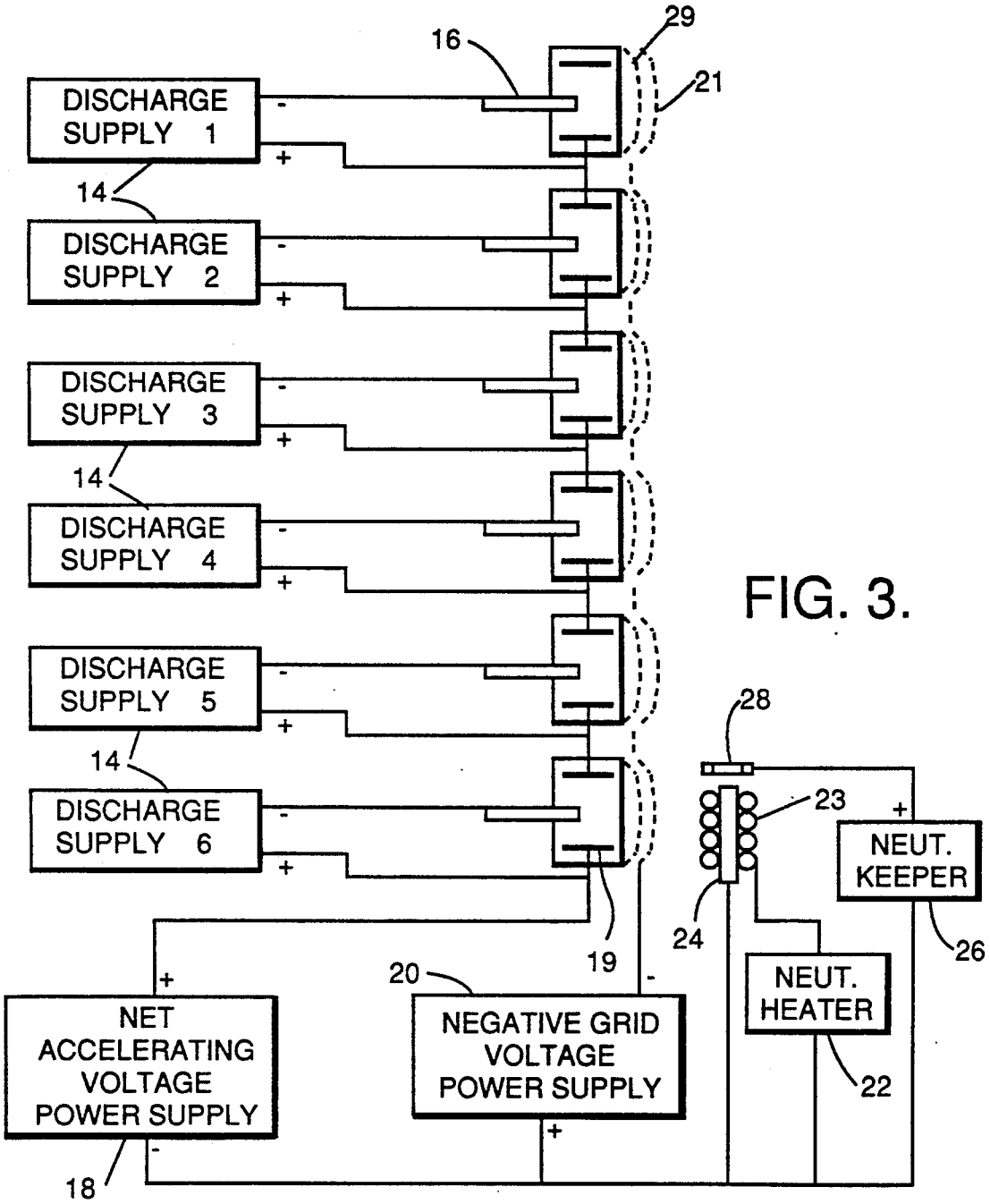
FIG. 3 is a schematic diagram of a power supply for the segmented ion thruster with si segments of FIG. 2.

The six individual ion source segments 11 are configured to operate as a single ion engine from a single power processor unit as suggested in FIG. 3 Multiple discharge power supplies 14, as indicated in this schematic, are used to individually control the emission current from each cathode 16. A similar arrangement of multiple discharge supplies was used to operate the 1.5-m diameter, 130-kW mercury ion engine, as is described in the paper by Nakanishi and Pawlik mentioned above. Heater power supplies for the segment cathodes 16 are not shown because the individual discharge supplies 14 could be used to heat the cathodes 16 for startup. Similarly, separate cathode starter power supplies are not shown.

The high voltage required to start the cathode is assumed to come from a boost supply which is included in the discharge supply 14. A single positive net accelerating voltage power supply 18 is connected to anode 19, a single negative grid high-voltage power supply 20 is connected to anode 21, and a single set of neutralizer power supplies 22 and 26 complete the power processor unit for the segmented ion thruster 10. Neutralizer heater power supply 22 is connected to neutralizer heater 23 which is adjacent neutralizer 24. Neutralizer keeper power supply 26 is connected to neutralizer keeper electrode 28. Screen grids are denoted by numeral 29.

Although not shown in FIG. 3, in practice each of the segments 11 would be electrically isolated from the others through its own high-voltage propellant isolators and insulating standoffs. If a high-voltage fault (such as a short from screen 30 to accelerator 19) should develop in one segment 11, that segment would be shut down and then isolated from the high-voltage power supplies 18 and 20 through the use of relays. Thus, failure of one segment would not result in complete failure of the engine, but instead the engine thrust would be multiplied by the factor $(N_s-1)/N_s$.

The segmented ion thruster design may, in some sense, be considered as the third step in ion engine evolution to higher power levels. The lowest power ion sources are made with accelerator systems that consist of a single aperture. Child's law limits the total current that can be extracted from this single aperture for a given applied voltage, and typical power levels are tens of watts.

Second-generation ion sources make use of multiple-aperture accelerator systems. The current per hole is still limited by Child's law but multiple holes are used to significantly increase the total current. For multiple-aperture grid systems the total current is limited by the achievable span-to-gap ratio and by the maximum electric field which can be sustained between the grids. With multiple-aperture grid systems steady-state ion engine power levels of up to 130 kW have been demonstrated.

The third step makes use of multiple grid sets per engine. Span-to-gap and electric field considerations still limit the current per grid set but multiple grid sets are used to significantly increase the total beam current. Total engine power levels of substantially greater than 100 kW should be relatively easily achievable. This engine configuration is somewhat analogous to a multi-cylinder automobile engine. An alternate analogy is that of segmented mirrors used in the development of large optical telescopes.

The segmented engine design approach is feasible largely because of the use of noble gas propellants rather than mercury. The propellant flow control system for noble gas propellants is substantially simpler than for mercury. As far as the high-voltage power supplies are concerned, the segmented ion thruster configuration is electrically indistinguishable from more conventional nonsegmented configurations. That is, the positive high-voltage power supply which accelerates the ions cannot tell that the ions originate from separate discharge chambers.

The segmented ion thruster approach enables large total accelerator system areas to be achieved through the use of smaller and more manageable individual ion source components. The use of relatively small ion chamber diameters mitigates the span-to-gap problem central to the development of large-area, high-power ion engines. Furthermore, each segment has a dedicated hollow cathode which operates at a fraction of the total engine discharge current (depending on the number of segments in the engine). This decreased discharge current requirement and the use of one cathode per ion chamber has the following additional advantages relative to other high-power ion engine design approaches: it minimizes th cathode-jet problem of high-current hollow cathodes, it mitigates the plasma uniformity problem characteristic of large-diameter engines or unusual engine geometries, and it eliminates the starting problems associated with the use of multiple cathodes in a single discharge chamber.

Performance Projections

Ion engine performance projections were made using equations appropriately modified for the segmented ion thruster configuration, from the paper by Brophy, J. R., and Aston, G., "A Detailed Model of Ion Propulsion Systems," AIAA Paper No. 89-2268, July 1989. Briefly, the beam current for a given segmented ion thruster configuration, assuming argon propellant, is calculated from a perveance expression in the following form:

$$J_b = N_s f_b \phi_s (NPPH)(D_b/l_e)^2 (M_{Xe}/M_{Ar})^{\frac{1}{2}} V_T^{\frac{3}{2}}, \quad (1)$$

where $N_s$ is the number of segments in the segmented ion thruster configuration and $D_b$ is the active beam diameter of each segment. The value for the normalized perveance per hole parameter, NPPH, was selected to provide the best fit to experimental perveance data for 30-cm diameter ion engines operating on xenon, as reported in the paper by Gilland, J. H., Myers, R. M. and Patterson, M. J., "Multimegawatt Electric Propulsion System Design Considerations," AIAA-90-2552, July 1990. The square root of the ratio of xenon to argon atomic masses corrects Eq. (1) for the use of argon instead of xenon. The total voltage, $V_T$, and effective acceleration length, $l_e$, in Eq. (1) are calculated for each case to be consistent with assumptions made for the maximum span-to-gap ratio, the maximum electric field between the grids, and the desired specific impulse. Once the beam current is calculated from Eq. (1) the thrust and input power are calculated as follows:

$$T=N_s\gamma J_b(2M_{Ar}V_TR/e)^{\frac{1}{2}}, \quad (2)$$

and $$P=N_sJ_b\{V_TR+\epsilon_b+V_c+(J_A/J_b)(1-R)V_T\}+N_sJ_{nk}V_{nk}, \quad (3)$$

Figure 5:
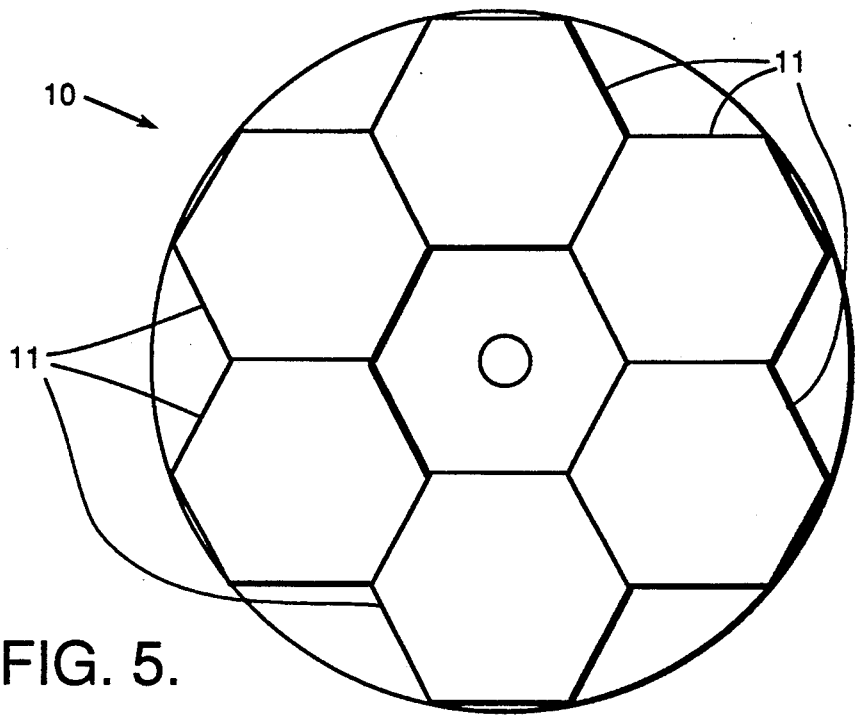
FIG. 5 depicts an alternative configuration of the segmented ion thruster having six segments.

The segmented ion thruster approach is applicable to any individual chamber size and any number of chambers per engine. Possible segmented ion thruster engine configurations with 3, 4, 6, and 8 chambers are shown in FIGS. 4a, 4b, 4c, and 4d, respectively, in which the dimensions are indicated in arbitrary units. As before, the segment active grid area is represented by reference numeral 12 and the neutralizer by 28. An alternative arrangement of six chambers for a segmented ion thruster 10 is shown in FIG. 5.

Figure 6:
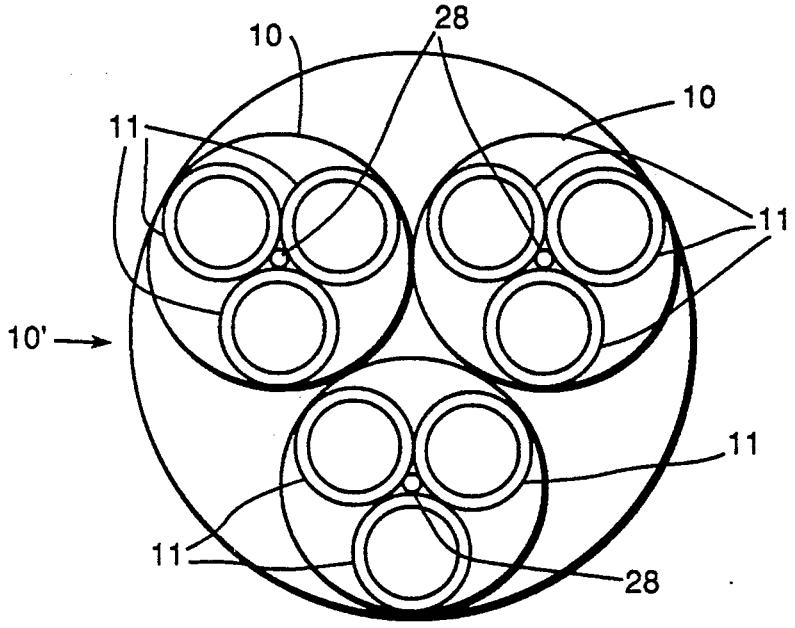
FIG. 6 depicts a connected array of three segmented ion thrusters each having three segments.

The invention also encompasses a connected array 10' of segmented ion thrusters 10 arranged symmetrically, an example of which is depicted in FIG. 6. The example shown comprises three segmented ion thrusters 10 connected together to give an active grid area nine times that of an individual segment 11.

Projected segmented ion thruster engine performance values are given in Table 1 for individual segments with 30, 50, 75, and 100-cm diameters.

Figure 9:
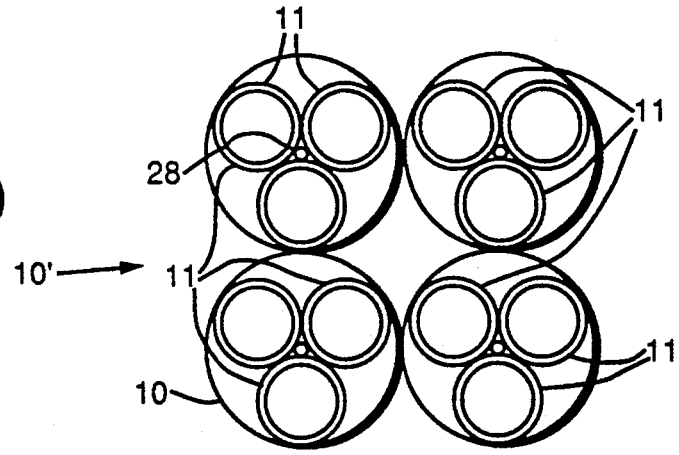
FIG. 9 depicts a connected square array of four segmented ion thrusters each having three segments.

A second example of a connected array 10' of segmented ion thrusters 10 arranged symmetrically is depicted in FIG. 9. The example shown comprises four segmented ion thrusters 10 connected together in a square configuration to give an active grid area 12 times that of an individual segment 11.

Figure 10:
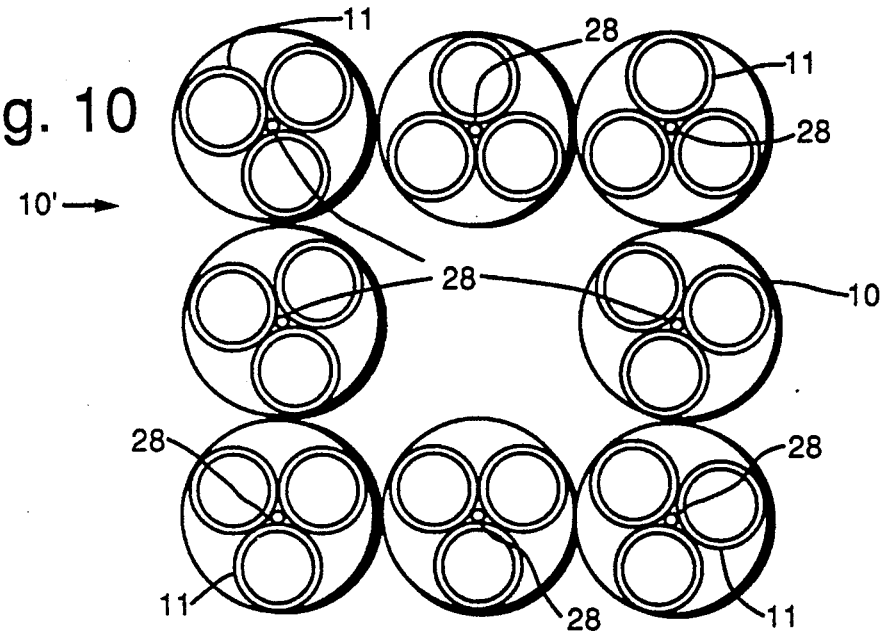
FIG. 10 depicts a connected square array of eight segmented ion thrusters each having three segments.

A third example of a connected array 10' of segmented ion thrusters 10 arranged symmetrically is depicted in FIG. 10. The example shown comprises eight segmented ion thrusters 10 connected together in a square configuration to give an active grid area 24 times that of an individual segment 11.

Figure 11:
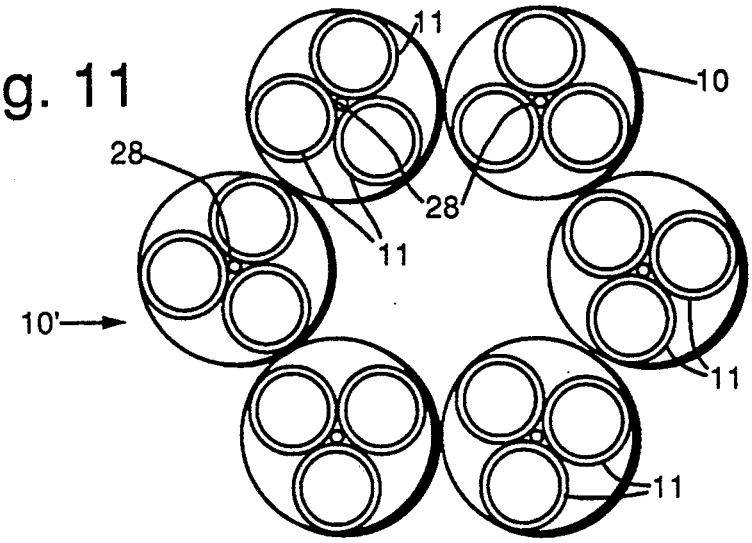
FIG. 11 depicts a connected hexagonal array of six segmented ion thrusters each having three segments.

A fourth example of a connected array 10' of segmented ion thrusters 10 arranged symmetrically is depicted in FIG. 11. The example shown comprises six segmented ion thrusters 10 connected together in a hexagonal configuration to give an active grid area 18 times that of an individual segment 11.

TABLE 1

PROJECTED PERFORMANCE OF SEGMENTED ION THRUSTERS

| | 30-cm SIT | 50-cm SIT | 75-cm SIT | 100-cm SIT |
|---|---|---|---|---|
| Number of Segments | 6 | 6 | 8 | 8 |
| Segment Diameter (cm) | 30 | 50 | 75 | 100 |
| Specific Impulse (s) | 10,000 | 10,000 | 10,000 | 10,000 |
| Maximum Power into Engine (kW) | 100 | 289 | 844 | 1640 |
| Engine Efficiency | 0.69 | 0.70 | 0.70 | 0.70 |
| Thrust (N) | 1.42 | 4.10 | 12.0 | 23.2 |
| Propellant Flow Rate (g/s) | 0.014 | 0.042 | 0.12 | 0.24 |
| Propellant Efficiency | 0.80 | 0.80 | 0.80 | 0.80 |
| Total Grid Area (m2) | 0.383 | 1.11 | 3.53 | 6.28 |
| Equivalent Diam. (m) | 0.70 | 1.19 | 2.12 | 2.83 |
| Engine Mass (kg) | 50 | 120 | 300 | 440 |
| Each Segment | | | | |
| Input Power (kW) | 16.7 | 48.2 | 106 | 205 |

TABLE 1-continued

PROJECTED PERFORMANCE OF SEGMENTED ION THRUSTERS

| | 30-cm SIT | 50-cm SIT | 75-cm SIT | 100-cm SIT |
|---|---|---|---|---|
| Beam Current (A) | 4.7 | 13.6 | 29.7 | 57.6 |
| Discharge Current (A) | 18.2 | 59.3 | 130 | 252 |
| Discharge Voltage (V) | 45.0 | 40.0 | 40.0 | 40.0 |
| Grid Gap* (mm) | 1.4 | 1.4 | 1.5 | 1.4 |
| Beam Voltage (V) | 3360 | 3360 | 3360 | 3360 |
| Total Voltage (V) | 3730 | 3730 | 3730 | 3730 |
| Span-to-Gap Ratio | 200 | 338 | 500 | 700 |
| Screen Hole Diam. (mm) | 2.2 | 2.2 | 2.2 | 2.2 |
| Screen Grid Thickness (mm) | 0.56 | 0.56 | 0.63 | 0.56 |
| Discharge Propellant Efficiency | 0.85 | 0.85 | 0.85 | 0.85 |

*Assumes a maximum electric field of 2600 V/mm

The first two columns in Table 1 refer to segmented ion thruster configurations with six segments per engine, whereas for the last two columns eight segments are used. The first column in this table refers to relatively conservative engine performance which can be achieved using six state-of-the-art 30-cm diameter chambers. This segmented ion thruster configuration has a total grid area equivalent to a 70-cm diameter circular engine. The maximum total engine input power for this configuration would be 101 kW with an overall efficiency of 69% at a specific impulse 10,000 seconds. Each of the six segments must process one sixth of this power, or 16.7 kW each. For each segment this is accomplished by operating with a beam current of 4.73 A at a beam voltage 3360 V. Assuming a discharge voltage of 45.0 V and a discharge loss of 175 eV/ion, the discharge current per chamber is only 18.2 A. These parameters are well within the current state-of-the-art for 30-cm diameter ion sources. The J-Series thruster has been operated at beam currents up to 5.9 A with argon propellant (as reported in the paper by Rawlin, V.K., "Operation of the J-Series Thruster Using Inert Gas, "NASA TM 82977, November 1982), and at input power levels of up to 17 kW with xenon (Patterson, M. J. and Rawlin, V. K., "Performance of 10-kW Class Xenon Ion Thrusters," AIAA 88-2914, July 1988). The total thruster beam current is 6 times 4.73 A, which is 28.4 A, and greater than 95 kW (28.4 A×3360 V) of the input power is contained in the exhaust.

Using the approach of the present invention a 100-kW argon ion engine can be built utilizing existing technology, and the building and testing of such an engine will provide the necessary experience for the development of larger, higher-power segmented ion engines of the future.

Figure 7:
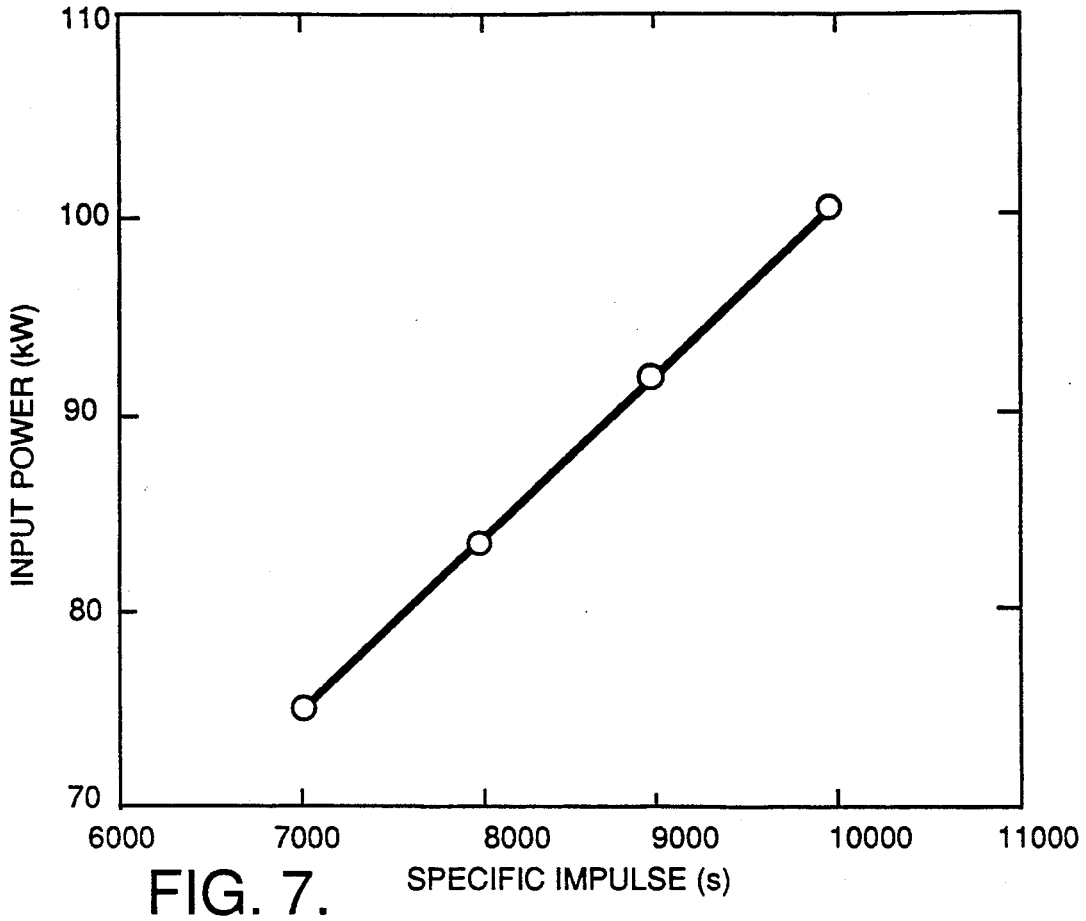
FIG. 7 is a graph of the variation of input power as a function of specific impulse for the segmented ion thruster having six 30-cm segments.

Projected performance data for the 6×30-cm segmented engine are given in Table 2 over the range of specific impulses from 7000 to 10,000 s, and the input power versus $I_{sp}$ from this table is plotted in FIG. 7.

The second column in Table 1 indicates the projected performance which can be achieved through the use of a 6×50-cm segmented ion engine. Specifically, this engine, which would consist of six 50-cm diameter ion sources, can process over a quarter of a megawatt at a specific impulse of 10,000 s.

TABLE 2

PROJECTED PERFORMANCE VERSUS $I_{sp}$ FOR 6 × 30-cm SEGMENTED ION ENGINE

| Isp = | 7000 s | 8000 s | 9000 s | 10000 s |
|---|---|---|---|---|
| Input Power (kW) | 74.9 | 83.5 | 92.2 | 101 |
| Thrust (N) | 1.43 | 1.43 | 1.43 | 1.43 |
| Total Engine Efficiency | 0.66 | 0.67 | 0.68 | 0.69 |
| Total Beam Current (A) | 40.6 | 35.5 | 31.6 | 28.4 |
| Beam Voltage (V) | 1650 | 2150 | 2720 | 3360 |
| Grid Gap* (mm) | 0.69 | 0.90 | 1.14 | 1.40 |
| Total Propellant Flow Rate (g/s) | .0209 | .0182 | .0162 | .0146 |

*Assumes a maximum electric field of 2600 V/mm

Operation of 50-cm diameter chambers with argon propellant at a specific impulse of 10,000 s requires an accelerator system with a span-to-gap ratio of only 338, which is significantly less than the state-of-the-art for 30-cm thrusters. Furthermore, the use of relatively high applied voltages means that the accelerator system electrodes can be more robust (i.e., thicker) than those designed for closer grid spacings and lower voltages. With this approach a 0.25-MW argon ion engine should be possible.

The third column in Table 1 gives the performance of an 8×75-cm segmented thruster. For operation with argon at a specific impulses of 10,000 s and a maximum electric field of 2600 V/mm, assigning the span-to-gap ratio equal to the present state-of-the-art (i.e. 500) results in a chamber diameter of approximately 75 cm. The use of eight 75-cm chambers results in an ion engine which can process over 800 kW and produce a thrust of greater than 10 N. Each 75-cm chamber requires a discharge current of 130 A assuming a discharge voltage of 40 V. A 12.7-mm diameter hollow cathode has been operated on argon at emission currents of up to 150 A for as long as 24 hours and at 100 for 1,000 hours, as reported in the paper by Brophy and Garner, "Tests of High Current Hollow Cathodes for Ion Engines," AIAA Paper No. 88-2913, July 1988.

The development of such an engine requires scaling a 50-cm diameter ion chamber up to 75 cm. In particular, the development of a 75-cm diameter, high-voltage accelerator system with a span-to-gap ratio of 500 is required. Long duration tests of hollow cathodes operating with emission currents greater than 100-A are necessary. The significance of the segmented design approach is that an 800-kW argon ion engine (with a specific impulse of 10,000 s) can be built without requiring the development of an ion accelerator system which has a span-to-gap ratio that is greater than the current state-of-the-art. (Note, the effective span-to-gap of this engine design is 1400, based on an effective engine diameter of 2.12 m.) Furthermore, hollow cathodes have already been tested at emission currents necessary to support development of such an engine. Thus, the development of 800-kW class argon ion engines should be readily achievable.

The power density of this engine is no greater than that of the 30-cm diameter J-Series ion engine operating at 17 kW, and at this power level the J-Series thruster was demonstrated to be self-radiating. Consequently, the 8×75-cm segmented engine will not require active cooling even at 800 kW. The engine specific mass will be less than 0.4 kg/kW.

The fourth column in Table 1 gives the estimated performance for an 8×100-cm segmented ion engine. In this case the engine consists of eight 100-cm diameter ion chambers, which together can process a maximum input power of 1.6 MW and produce a thrust of 23 N at a specific impulse of 10,000 s. The span-to-gap ratio required for the accelerator system of each 100-cm diameter chamber is 700 (the effective span-to-gap ratio based on the equivalent circular engine diameter is over 2000). The discharge current for each chamber is 250 A.

The development of a 1.6 MW argon ion engine is a technically reasonable objective which would require scaling the chamber diameter by a factor of 2 from the existing 50-cm chamber and increasing hollow cathode current capability from the 100–150 A range to 250 A. Referring to FIG. 4*d*, such an engine would fit within a square which is 4 m on a side and have a mass of approximately 440 kg (for a specific mass of approximately 0.3 kg/kW). Power density considerations dictate that the engine would be self-radiating at 1.6 MW. The overall engine efficiency would be approximately 70%.

Figure 8:
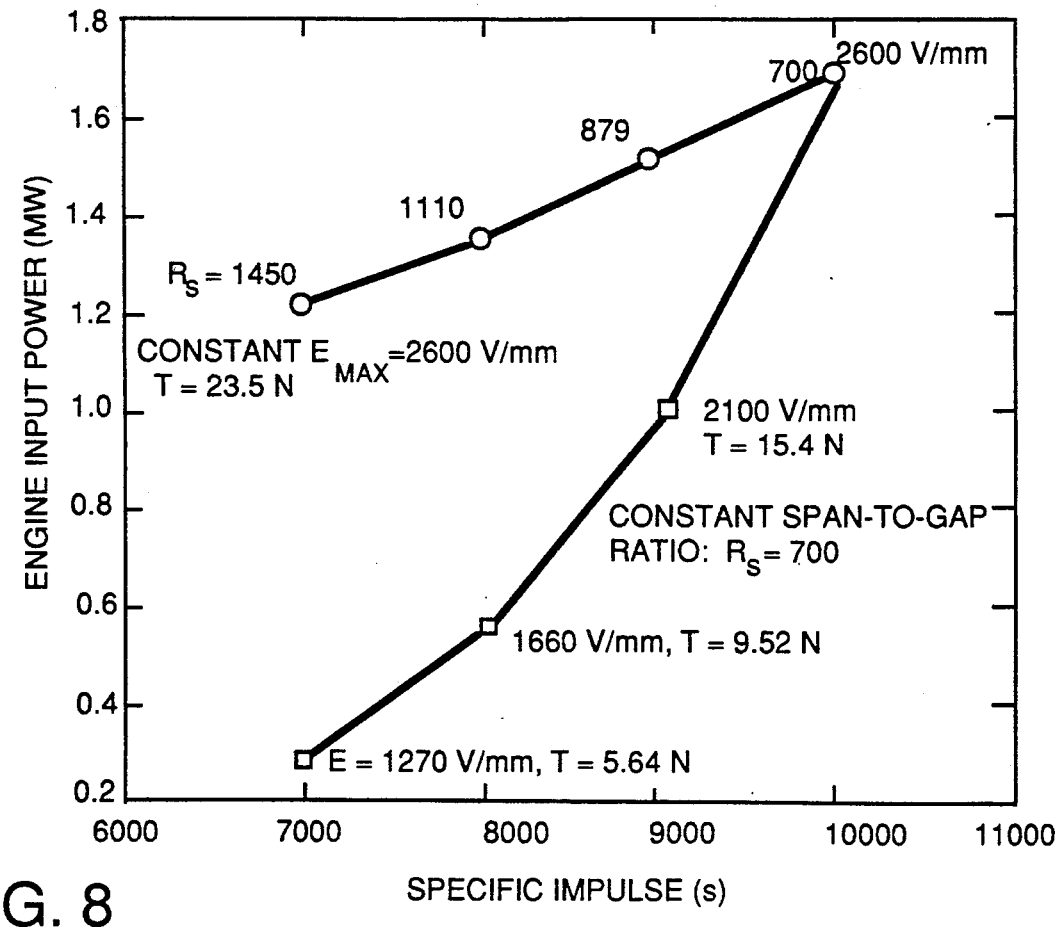
FIG. 8 is a graph of the variation with specific impulse of performance for the segmented ion thruster having eight 100-cm segments, assuming constant $E_{max}$ and $R_s$.

Operation of the 8×100-cm thruster at specific impulses less than 10,000 s will result in decreased power handling capability (if the maximum span-to-gap ratio is maintained at 700) or will require 1-m diameter accelerator systems with significantly greater span-to-gap ratios as shown in FIG. 8 and Tables 3 and 4.

TABLE 3

PROJECTED PERFORMANCE FOR 8 × 100-cm SIT at $E_{max}$ = 2600 V/mm

| Isp = | 7000 s | 8000 s | 9000 s | 10000 s |
|---|---|---|---|---|
| Input Power (MW) | 1.23 | 1.37 | 1.51 | 1.66 |
| Thrust (N) | 23.5 | 23.5 | 23.5 | 23.5 |
| Total Engine Efficiency | 0.66 | 0.67 | 0.68 | 0.69 |
| Total Beam Current (A) | 666 | 583 | 518 | 466 |
| Total Discharge Current (A) | 2914 | 2550 | 2270 | 2040 |
| Grid Gap (mm) | 0.69 | 0.90 | 1.14 | 1.40 |
| Span-to-Gap Ratio | 1450 | 1110 | 879 | 712 |
| Accelerator System Electric Field (V/mm) | 2600 | 2600 | 2600 | 2600 |
| Total Propellant Flow Rate (g/s) | 0.342 | 0.300 | 0.266 | 0.240 |

TABLE 4

PROJECTED PERFORMANCE FOR 8 × 100-cm SIT WITH CONSTANT SPAN-TO-GAP RATIO

| Isp = | 7000 s | 8000 s | 9000 s | 10000 s |
|---|---|---|---|---|
| Input Power (MW) | 0.295 | 0.560 | 0.992 | 1.66 |
| Thrust (N) | 5.64 | 9.62 | 15.4 | 23.5 |
| Total Engine Efficiency | 0.66 | 0.67 | 0.68 | 0.69 |
| Total Beam Current (A) | 160 | 239 | 340 | 466 |
| Total Discharge Current (A) | 699 | 1040 | 1490 | 2040 |
| Grid Gap (mm) | 1.40 | 1.40 | 1.40 | 1.40 |
| Span-to-Gap Ratio | 700 | 700 | 700 | 700 |
| Accelerator System Electric Field (V/mm) | 1270 | 1660 | 2110 | 2600 |
| Total Propellant Flow Rate (g/s) | 0.082 | 0.123 | 0.175 | 0.240 |

Engine Performance and Life Testing

High-power ion engines will require both performance and life testing. Life testing places greater demands on a vacuum test facility because of the necessity to perform long-duration tests at very low pressures.

Vacuum system pressures less than $10^{-5}$ torr during engine operation are required to minimize accelerator grid erosion due to facility induced charge-exchange ions. To life test a 100-kW argon ion engine at a pressure of $5\times10^{-6}$ torr requires a pumping speed of $1.2\times10^{6}$ liters/s, and life testing a 1.6-MW engine requires $2.0\times10^{7}$ liters/s. Ion engine performance testing, on the other hand, can generally be done at vacuum system pressures as high as $3\times10^{-5}$ torr, so that pumping speed requirements for performance testing are generally only about one sixth that required for life testing.

For the segmented ion thruster, most of the development work can be performed at the segment level. Major life-limiting design deficiencies can be identified by life testing individual segments. Life testing at the segment level reduces the pumping speed requirements by $1/N_s$ relative to life testing the complete engine. The complete engine has to be performance tested and segment-to-segment interactions identified. A life test of the complete engine may not be necessary depending on the extent of these interactions.

Reliability

The segmented ion thruster design approach allows the development of 100-kW class ion engines and may enable the development of megawatt class engines. Although this is accomplished at the expense of increased engine and power processor complexity, it should be noted that increased complexity does not always result in reduced reliability. The benefits of the segmented design, i.e., reduced span-to-gap requirements, reduced cathode emission current requirements, increased fault tolerance, and reduced vacuum system pumping speed requirements, must be weighed against the increased complexity.

Arcing

Ion accelerator system operation at voltage differences of a few thousand volts between electrodes spaced 1.4 mm apart with plasmas on both sides of the electrodes will occasionally produce a high-current low-voltage arc discharge between the electrodes. To clear this low-voltage arc and restore normal engine operation, it is necessary to remove the voltages from the electrodes for some period of time (typically on the order of one second) and then reapply the voltages. This capability for high-voltage "recycling" is built into the design of the high-voltage power supplies for ion engines. Recycling rates are generally a function of the electric field stress between the electrodes and the current density of ions extracted. It would also seem likely that the recycle rate is a function of the total active grid area, all else being equal. Thus, one may expect that a large area ion engine may recycle more frequently than a smaller one under identical operating conditions.

Extended tests of 30-cm diameter xenon ion engines with electric field stresses of 2300 to 2400 V/mm have resulted in average recycle rates of between 1.5 and 2.4 recycles/hour (as reported in the paper by Patterson, M.J. and Verhey, T.R., "5 kW Xenon Ion Thruster Life Test," AIAA Paper No. 90-2543, July 1990, and in the paper by Rawlin, V. K., "Internal Erosion Rates of a 10-kW Xenon Ion Thruster," AIAA Paper No. 88-2912, July 1988). If the recycle rate scales with active grid area then the 6×30-cm segmented ion thruster may have a recycle rate of between 9 and 15 recycles/hour. Scaling the recycle rate with beam area up to the 8×100-cm segmented ion thruster size results in a recycle rate of between 135 and 216 recycles/hour, which is one recycle every 17 to 26 seconds. This is clearly an unacceptable recycling rate, but the recycling rates, taken from the paper by M.J. Patterson and T. R. Verhey and the paper by V. K. Rawlin, upon which this conclusion is based, may be artificially high as a result of operation at relatively high vacuum chamber pressures which significantly increased the erosion rates of the accelerator grids in these tests.

Conclusions

Methods and apparatus have been presented for a segmented ion thruster comprising multiple discharge chambers and ion accelerator systems and making possible 100-kW class ion engines using components from existing 30-cm diameter ion engines. Furthermore, this design approach may enable the development of megawatt class ion engines by reducing the performance requirements of key engine components, such as the ion accelerator system and the main discharge hollow cathode. Benefits of the segmented ion thruster design approach include: reduction in the required accelerator system span-to-gap ratio for large-area engines, reduction in the required hollow cathode emission current, mitigation of the plasma uniformity problem associated with large-area ion engines, increased tolerance of accelerator system faults, and reduction in the vacuum system pumping speed required for engine development testing. The optimum number of segments per engine is a trade-off between these benefits and the engine and power processor system complexities, which increase with the number of segments. Useful megawatt-class ion engines must have high-voltage recycle rates that are comparable to present state-of-the-art engines.

Those having skill in the arts relevant to the present invention will undoubtedly think of various obvious modifications or additions to the invention based upon the preferred embodiment disclosed herein. Therefore, it should be understood that the invention is not to be limited to the disclosed embodiment, but is to be limited only by the scope of the following claims.

I claim:

1. A segmented ion thrust device comprising a plurality of substantially identical subchambers, each constituting an individual ion source, in a symmetrical configuration; a single power processor unit to operate said thrust device; and a centrally single located neutralizer to effect beam neutralization in said device.

2. The ion thrust device of claim 1 wherein there are two said subchambers symmetrically arranged about a longitudal axis on which said neutralizer is centered.

3. The ion thrust device of claim 1 wherein there are three said subchambers and said symmetrical configuration is equilaterally triangular.

4. The ion thrust device of claim 1 wherein there are four said subchambers and said symmetrical configuration is square.

5. The ion thrust device of claim 1 wherein there are eight said subchambers and said symmetrical configuration is square.

6. The ion thrust device of claim 1 wherein there are six said subchambers and said symmetrical configuration is hexagonal.

7. The ion thrust device of claim 1 wherein a noble gas is used as used as propellant.

8. An ion thruster comprising a connected array of segmented ion thrust devices, each including a plurality of substantially identical subchambers, each constituting an individual ion source, in a first symmetrical configuration, each said segmented ion thrust device arranged to operate from a single power processor unit, and to accomplish beam neutralization through the use of a centrally single located neutralizer, said array comprising a plurality of said segmented ion thrust devices arranged in a second symmetrical configuration.

9. The ion thruster array of claim 8 wherein there are first and second said segmented ion thrust devices having first and second thrust axes, respectively, which are parallel to each other.

10. The ion thruster array of claim 8 wherein there are three said segmented ion thrust devices and said second symmetrical configuration is equilaterally triangular.

11. The ion thruster array of claim 8 wherein there are four said segmented ion thrust devices and said second symmetrical configuration is square.

12. The ion thruster array of claim 8 wherein there are eight said segmented ion thrust devices and said second symmetrical configuration is square.

13. The ion thruster array of claim 8 wherein there are six said segmented ion thrust devices and said second symmetrical configuration is hexagonal.

14. The ion thruster array of claim 8 wherein a noble gas is used as used as propellant.

* * * * *

UNITED STATES PATENT AND TRADEMARK OFFICE

CERTIFICATE OF CORRECTION

PATENT NO. : 5,269,131

DATED : December 14, 1993

INVENTOR(S) : John R. Brophy

It is certified that error appears in the above-identified patent and that said Letters Patent is hereby corrected as shown below:

In Claim 1, Line 47 of Column 12 should read:

"thrust device; and a single centrally located neutralizer".

Signed and Sealed this

Twentieth Day of December, 1994

*Attest:*

Bruce Lehman

BRUCE LEHMAN

*Attesting Officer*

*Commissioner of Patents and Trademarks*